United States Patent [19]

Matsukura et al.

[11] 3,976,514

[45] Aug. 24, 1976

[54] METHOD FOR PRODUCING A HIGH TOUGHNESS AND HIGH TENSIL STEEL

[75] Inventors: Kameo Matsukura; Kunio Watanabe; Yoshio Hashimoto, all of Sakai; Masatoki Nakayama; Hajime Nakasugi, both of Kisarazu; Tetuo Takeda, Kimitsu, all of Japan

[73] Assignee: Nippon Steel Corporation, Tokyo, Japan

[22] Filed: Feb. 10, 1975

[21] Appl. No.: 548,617

[52] U.S. Cl. ..... 148/12 F

[51] Int. Cl.[2] ..... C21D 7/14

[58] Field of Search ..... 148/12 F; 75/123 E

[56] References Cited

UNITED STATES PATENTS

| | | | |
|---|---|---|---|
| 3,645,801 | 2/1972 | Melloy et al. | 148/12 F |
| 3,671,336 | 6/1972 | Korchynsky et al. | 148/12 F |
| 3,711,340 | 1/1973 | Korchynsky et al. | 148/36 |
| 3,787,250 | 1/1974 | Korchynsky et al. | 148/12 F |

*Primary Examiner*—W. Stallard

*Attorney, Agent, or Firm*—Toren, McGeady and Stanger

[57] ABSTRACT

A method for producing a high tensile strength steel plate which comprises subjecting to a low temperature rolling, a steel composition containing not more than 0.25% of carbon, not more than 0.5% of silicon, 0.5 to 2.0% of manganese, not more than 0.015% of sulfur, 0.005 to 0.1% of aluminum, one or more of niobium, vanadium and titanium in an amount not less than 0.01%, and REM in an amount not less than 1.3 times the amount of sulfur, with optionally one or more of nickel, chromium and copper, with the balance being iron and unavoidable impurities, which steel possesses a low notch toughness transition temperature and high absorbed energy in the notch-impact test, and is suitable in the as rolled condition for use as pipe lines in cold districts.

3 Claims, 6 Drawing Figures

RELATION BETWEEN REM/S AND VE SHELF

COMPARISON BETWEEN CHARPY TEST SPECIMENS AND MULTI-LAYER IMPACT TEST SPECIMENS

RELATION BETWEEN SULFER CONTENTS AND SHELF-ENERGY

RELATION BETWEEN INLET TEMPERATURE OF FINISHING ROLLING AND CHARPY FRACTURE APPEARANCE TRANSITION TEMPERATURE

RELATION BETWEEN REDUCTION AT 850°C OR LOWER AND VTrS.

RELATION BETWEEN FINISHING ROLLING TEMPERATURE AND TOUGHNESS

METHOD FOR PRODUCING A HIGH TOUGHNESS AND HIGH TENSIL STEEL

BACKGROUND OF THE INVENTION

1. Field of the Invention

The present invention relates to a method for producing a high toughness hot rolled high tensile steel plate by a low temperature rolling. More particularly, the present invention relates to a method for producing a high toughness and high tensile steel plate having excellent low-temperature toughness which is suitable for use in cold districts, and has as one of its objects to provide a method for producing a high toughness and high tensile steel plate suitable for production of electric resistance welded pipe and tubes, spiral pipes and UO pipe for pipe lines which are required to have low-temperature toughness in particular.

2. Description of the Prior Art

As for the conventional methods for producing a steel plate for pipe lines usuable in low-temperature districts, following two types of methods are known.

According to the first type of the conventional methods, a steel slab or ingot containing precipitation hardening elements, such as, Nb, Ti and V is heated to a temperature not lower than the solid solution temperature of these elements, and is then rolled with heavy reduction in a finishing temperature range to obtain a fine precipitation hardened steel. This method is commonly called "a controlled rolling method" (hereinafter abridged as CR method).

The second type of the conventional methods is directed to production of a quenched and tempered high tensile steel plate based on the microstructure transformation and precipitation by quenching and tempering.

In the case of the first type of the conventional methods, although the transition temperature is lowered by the so-called delamination phenomenon in which laminar crackings occur in parallel to the direction of crack propagation on the fracture of an impact test piece, the absorbed energy is remarkably lowered so that the steel plate produced by this method has been regarded to be of no use in applications where high energy is required at low temperatures.

Therefore, it has been long sought for to improve the absorbed energy by the controlled rolling (CR) of a niobium, titanium or vanadium containing steel.

However, in the case of the second type of the conventional methods, it is possible to assure high absorbed energy because of the freedom from the occurrence of delamination in the impact test piece as is confronted in the first type of the methods. However, this method requires separate heat treating equipment, thus causing an increase in the production cost. In the case of the production of thin-gauge steel plates, particularly those thinner than 20 mm, this method has a remarkable disadvantage with respect to the product having a flat shape, for example, as compared with the non-quenched and non-tempered steel plate.

Now it is generally known that the impact value of a steel plate shows a far better value in the direction parallel to the rolling direction (L direction) than in the direction transverse to the rolling direction (T direction). This results from the difference between the rolling reductions in the L and T directions from the slab stage or ingot to the final-shape stage. In the case of a hot rolled steel strip which has been rolled mainly in the longitudinal direction of the steel slab or ingot with almost no rolling in the axial direction of the steel slab or ingot, the ratio of the impact value in the L direction to that in the T direction reaches about 3.

However, electric resistance welded pipes and tubes, etc., for pipe lines as mentioned hereinbefore are required to have toughness in the T direction in practical use.

Therefore, the present invention provides a method for economically producing a hot rolled steel plate, for example, which has excellent low-temperature toughness satisfying the above requirements.

As one of the factors which lower the impact value in the T direction, there may be mentioned the presence of non-metallic inclusions which are composed mainly of manganese sulfides elongated in the rolling direction and cause notch effects on the test piece in the T direction, and thus elimination of the inclusions is very effective means for improving the impact value. Therefore, as a means for improving the impact value in the T direction, it has been conventionally proposed to add one or more of the rare earth metals, such as, La, Ce and Pd which convert MnS into a sulfide having little plasticity at the ordinary hot rolling temperature.

Meanwhile, as a value for indicating toughness the fracture appearance transition temperature is used other than the above impact value, and a lower fracture appearance transition temperature is directly related to a better low temperature toughness. However it has been confirmed by many researchers, for example, by studies of Brownrigg published in JISI Vol. 208, page 1078 (1970), that when one or more of the rare earth metals (hereinafter referred as REM), such as, La, Ce and Pr, is added for the purpose of improving the impact value as mentioned before, the fracture appearance transition temperature rises in some cases, and thus it has been known that REM can not always be added without restriction as the means for improving the toughness.

Furthermore, as an effective means for improving the low temperature toughness, heat treatment, such as, quenching and tempering, have been known and widely used for high-grade heavy steel plates, but such heat treatments present many difficulties in both the technical and economical aspects.

Also, it has been known to lower the transition temperature by means, such as, low temperature rolling and controlled rolling for the purpose of grain refining, but these means have been found not to contribute substantially to improvements in the shelf energy.

The present inventors have conducted studies for a many years on the production of a high tensile steel having excellent low temperature toughness, and have succeeded in clarifying the reason why REM addition raises the transition temperature and deteriorates the low temperature toughness and have discovered that, not only is the impact value improved over the whole temperature range, but also the transition temperature is lowered under the as rolled condition if the steel component elements including REM and S are specified and the rolling is done under certain conditions. The present invention is based on the above discovery.

Summary of the Invention

The gist of the present invention lies in a method for producing a high tensile steel having excellent low temperature toughness, which comprises rolling a steel containing not more than 0.25% of carbon, not more than 0.5% of silicon, 0.5 to 2.0% of manganese, not more than 0.015% of sulfur, 0.005 to 0.1% of aluminum, one or more of niobium, vanadium and titanium in an amount not less than 0.01%, one or more of lanthanum, cerium and praeseodymium as REM in an amount not less than 1.3 times the amount of sulfur with the balance being iron and unavoidable impurities in a temperature range not higher than 980°C with a reduction not less than 60%.

According to a preferable modification of the present invention, the sulfur range is limited to the lower side, and sulfides which elongate during the rolling are converted in relation with REM added in the specific range so as to prevent the elongation and to improve the notch impact energy. At the same time, the steel of the specific composition as defined above is rolled under specific rolling conditions so as to lower the notch transition temperature and to raise the notch impact absorbed energy.

The present invention will be described in more details referring to the attached drawings.

BRIEF DESCRIPTION OF THE DRAWINGS

FIG. 5 shows particularly the relation between the reduction at a temperature not higher than 850°C and *vTrs*, and FIG. 6 shows particularly the relation between the finishing temperature in the rolling and the toughness.

DESCRIPTION OF THE PREFERRED EMBODIMENT

Since steel plates for pipe lines generally have a thick wall up to about 20 mm, the steel is elongated about 100 times (rolling reduction of more than 80%) when the plates are produced by rolling, a steel ingot or slab.

Therefore, inclusions, such as, sulfides and silicates formed during solidification of the steel ingot or slab are remarkably elongated by the rolling, and such elongated inclusions lower the notch impact absorbed energy very remarkably.

In the production of straight welded steel pipes and tubes by forming, etc., the circumferencial direction stress (so-called main stress) acts at right angles to the direction of the elongated inclusions, and thus it is necessary to improve the notch impact value in the direction of the main stress.

Figure 1:
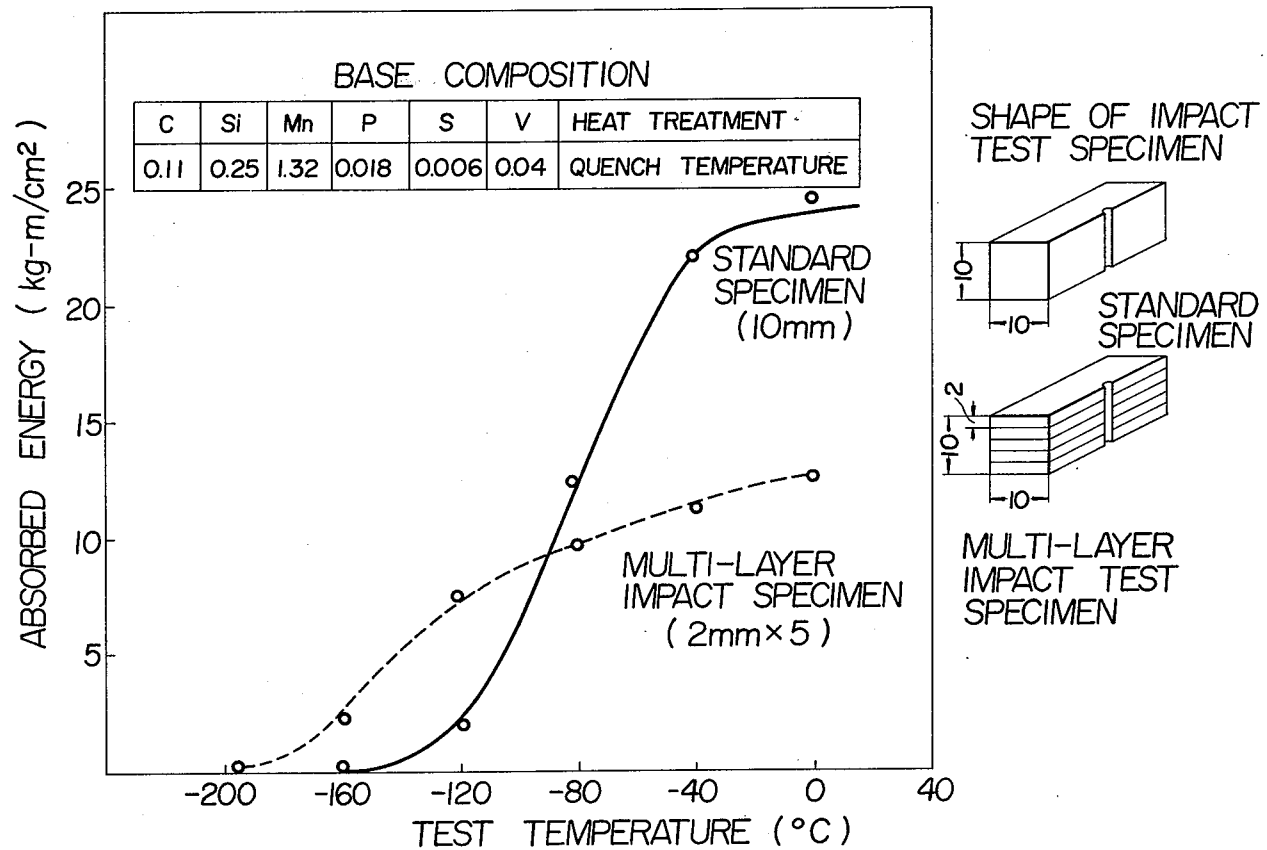
FIG. 1 is a graph showing comparison in impact test results between a standard test specimen and a multi layer impact test specimen.

Meanwhile, regarding the notch transition temperature, when the elongated inclusions are distributed in a laminar form, the steel separates into many layers (so-called delamination) immediately before the progress of the notch tip, so that the steel plate thickness is reduced substantially and the transition temperature lowers due to the lamination effect of a thin steel sheet (see FIG. 1).

Regarding the maximum absorbed energy (hereinafter called "shelf energy") of the notch impact energy, it has been found that it is determined by the product of the number (*ni*) of inclusions present and dispersed in the steel and their size (length *li* in the direction to parallel to notch tip progress). Thus, even when small inclusions are present in a large amount or when large inclusions are present, if $\Sigma lini$ is constant, the shelf energy remains almost constant. However, the correlation between $\Sigma lini$ and the shelf energy is seen only when the delamination as mentioned before does not take place. In the case when the delamination takes place, the local elongation lowers due to the thinning of the steel by multilayering and the shelf energy lowers remarkably. This is clear from the results of the multilayer impact test specimens.

As explained above, the shelf energy lowers always under the condition where the delamination takes place, even when $\Sigma lini$ is small.

Figure 2:
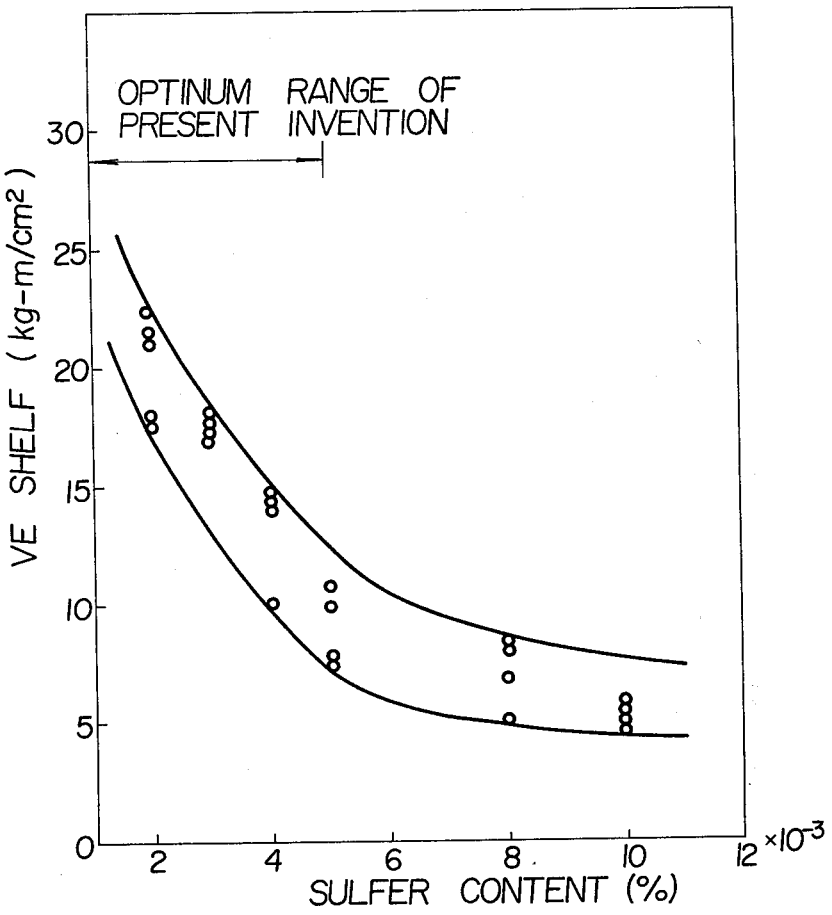
FIG. 2 is a graph showing the relation between the sulfur content in the steel and the shelf energy.

For the above reasons, in order to maintain the notch impact transition temperature to a lower temperature range without lowering the shelf energy, it is necessary to maintain $\Sigma lini$ as small as possible and increase the resistance against occurrence of the delamination. In order to lessen $\Sigma lini$, it is necessary to lessen the amount of the inclusions and shorten their length in the direction of the notch tip progress. In order to lessen the amount of the inclusions, it is necessary to control the addition of silicon and to kill the steel with aluminum with respect to the silicate. For this purpose, the acid-soluble aluminum (sol.Al) content should preferably be not less than 0.01%. With respect to the sulfide inclusions, it is of primary importance to lower the amount of sulfur. FIG. 2 shows the relation between the sulfur content and the shelf energy (in case of no delamination). It is understood from the results that the shelf energy is remarkably improved when the sulfur content is maintained not higher than 0.015% preferably 0.005%.

As for the means for shortening the length of the inclusions, it is enough to provide conditions under which the sulfides are not elongated during the rolling. Therefore, the present inventors have studied the effective utilization of REM which is a composite alloy of La, Ce, Pd, etc., and have found that the shelf energy can be further improved by adding REM in such an amount as to satisfy REM/S $\geq$ 1.3, preferably, in an amount between 0.005 and 0.025% and satisfying REM/S = 2 – 5.

Figure 3:
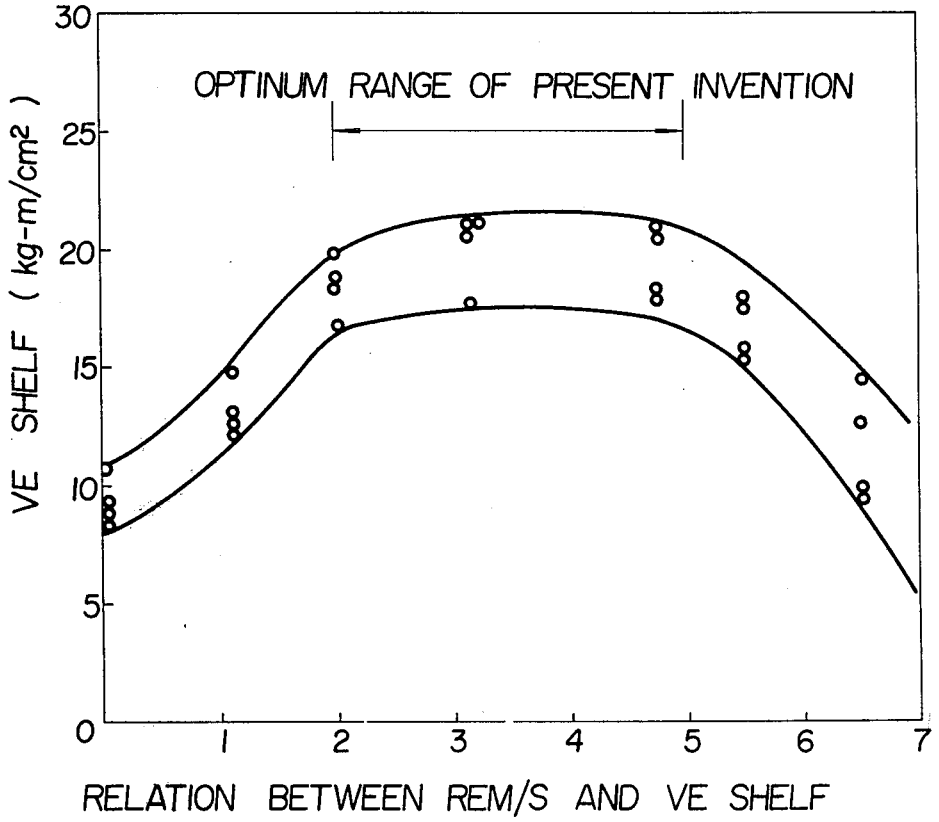
FIG. 3 is a graph showing the relation between the ratio of REM/S in the steel and the shelf energy.

The addition of REM necessary for improving the low temperature toughness coincides with the amount necessary for improving the impact value (absorbed energy), and as clear from FIG. 3 the absorbed energy becomes enough high in the range of $$REM \geq 1.3\ S\ (\%) \qquad 1.$$

Therefore, the content of REM alone or in combination is determined from the above. In this case, REM, such as, La and Ce may be added alone or in combination so far as the formula (1) is concerned. Also, misch metal containing rare earth metals may be added as ferro-alloy, such as, silicide. The most preferable ratio of REM/S is 2 – 5 as shown in FIG. 3.

On the other hand, when REM/S is beyond 5, the affinity of REM with [0] becomes stronger than that with S, and thus the oxysulfide of REM is produced in a large amount, increasing the amount of inclusions and increasing $\Sigma lini$, so that not only is the shelf energy lowered, but also ultra-sonic test defects are caused.

On the other hand, the total amount of REM is limited to not higher than 0.025% because the REM takes part in the stability of the welding arc, and when REM is beyond 0.025%, the voltage of the welding arc column becomes unstable, and in the case of a small heat input welding, molten metal tends to show unsatisfactory transferbility. Therefore, the back bead appearance in field welding of pipes is susceptible to bead unstability, so that defects are caused in the back beads to prohibit practical use. The difficulties in the field welding of pipes will present grave problems as automatic $CO_2$ welding is increasingly used. Therefore, it will be necessary to maintain REM not higher than 0.025%.

For the above reasons, in order to improve the shelf energy and to maintain weldability, from a practical viewpoint, S is not more than 0.005%, and REM is between 0.005 and 0.025% with REM/S being between 2 and 5. The shelf energy is improved by decreasing the amount of inclusions and shortening their length as noted above, but in some cases, the delamination takes place difficulty, and the notch transition temperature is raised so that the product is not useful in cold districts.

Therefore, in order to lower the notch transition temperature, it is necessary to introduce the delamination by other means. However as mentioned above, the shelf energy decreases in the case of delamination caused by the inclusions, and it is thus necessary to develop a method for absorbing energy in the case of existing delamination.

The present inventors have conducted various studies on the above method and have found that in the case of Nb-, and V-containing steels, delamination takes place and the generated energy increases under specific reheating and the rolling conditions and the lowering of shelf energy is less than in the case when the delamination is generated under other conditions and also the notch transition temperature lowers.

Figure 4:
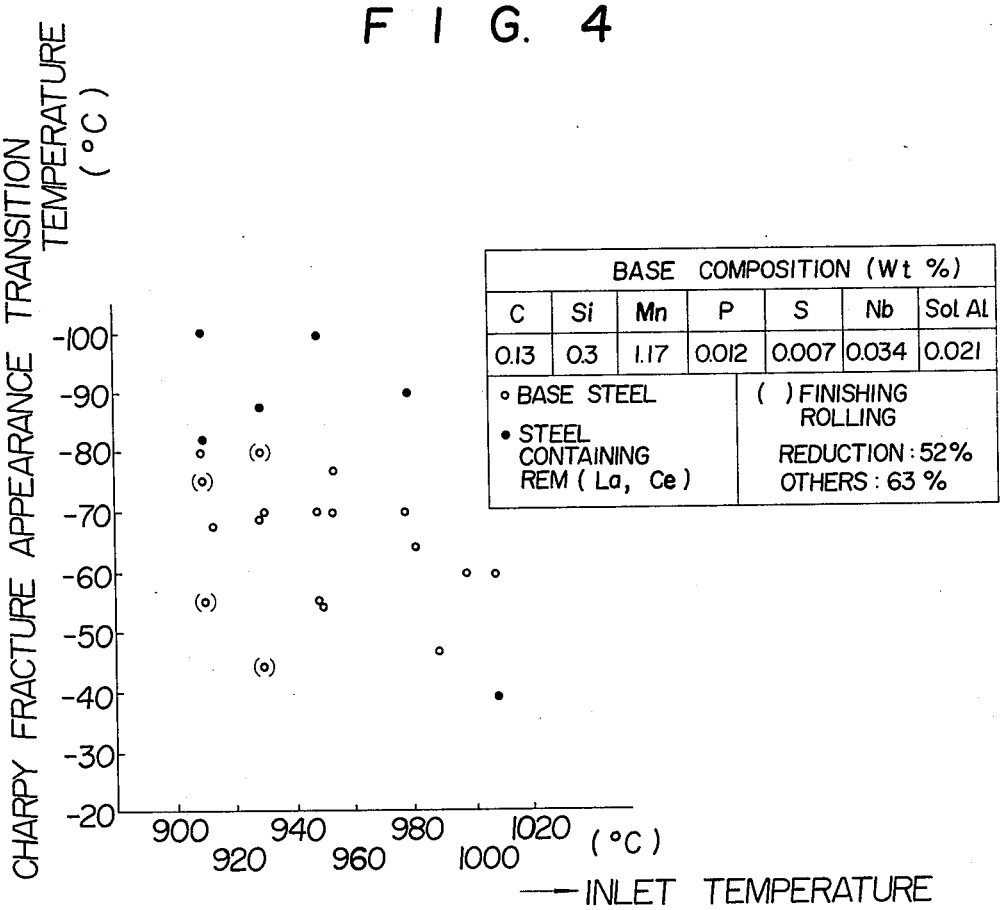
FIG. 4 is a graph showing the relation between the finishing temperature at the inlet of the finishing mill and the Charpy fracture appearance transistion temperature.

As clearly shown in FIG. 4, which shows the relation between the fracture appearance transition temperature and the inlet temperature of a finishing rolling mill, when the finishing rolling is effected at a temperature not higher than 980°C with a reduction of 63%, the fracture transistion temperature lowers considerably in REM-containing steels. The rolling at a temperature not higher than 980°C with more than 60% reduction may be effected in the finishing rolling step including part of a rough rolling step, or all through the finishing rolling step or further in a part of the finishing rolling step.

In the case of steels of the basic composition also the transition temperature lowers, but with less degree, as the rolling temperature lowers.

Figure 5:
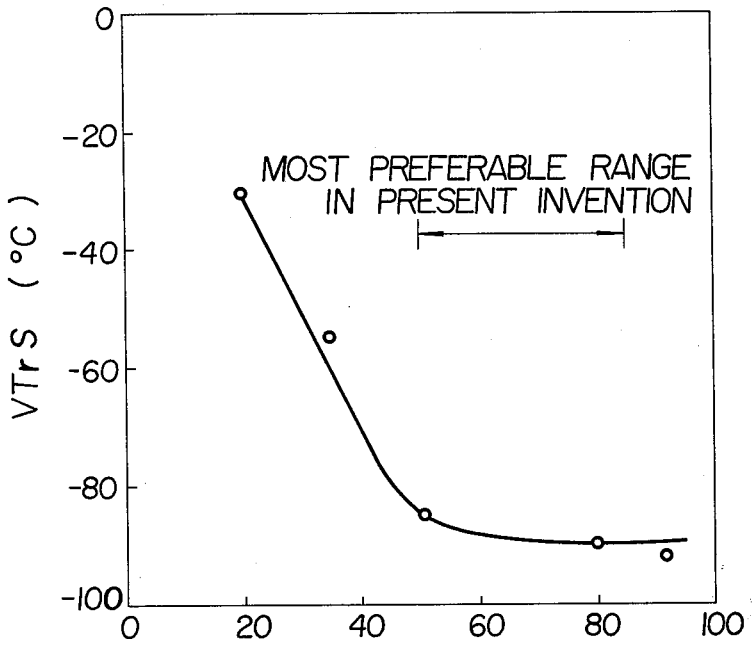
FIG. 5, and FIG. 6 are respectively, a graph showing the relation between the rolling conditions and the toughness.
Figure 6:
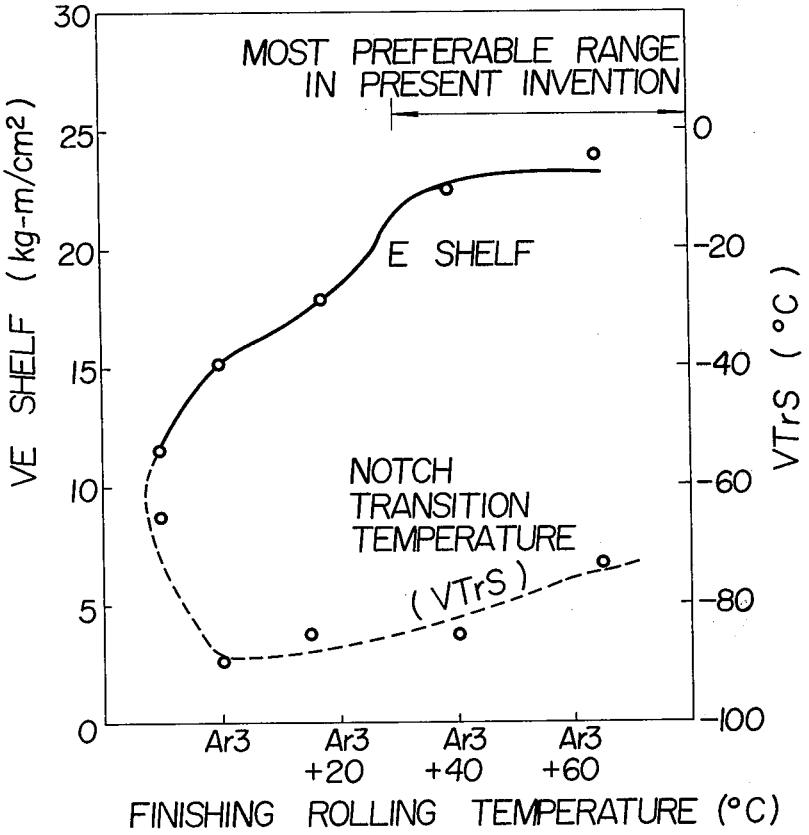

In the present invention, the steel is reheated for the rolling at a reheating temperature which dissolve in solid solution not less than 0.01% of at least one of Nb, V, etc., and the subsequent hot rolling is effected in a temperature range not higher than 980°C with a reduction of 60% or more. In the case when the total reduction is less than 50%, satisfactory improvement of the transition temperature is hard to obtain as shown in FIG. 5. Meanwhile, even when the total reduction is 50% or more, the transition temperature lowers when the finishing temperature is not higher than $Ar_3$ transformation point or just above the point, but the shelf energy lowers remarkably, thus failing to provide steel materials suitable for gas pipe lines which require high shelf energy and low transition temperature. In order to further lower the shelf energy, it is necessary to maintain the finishing temperature not lower than ($Ar_3$ transformation point + 30°C) as shown in FIG. 6. Thus, when the total reduction is 50% or more at a temperature 850°C or lower, a remarkably large amount of work is concentrated in the grain boundaries, and these grain boundaries are embrittled due to increased dislocation density, and the embrittled portions are destructed selectively by notch impact to cause delamination. The delamination caused under such conditions has less crack initiation resistance and low shelf energy. In order to increase the energy for delamination occurrence, it is necessary that the finishing temperature be limited to the above range along with the total reduction at a temperature not higher than 850°C. As shown in FIG. 6, as long as the finishing rolling is carried out at a temperature not lower than the value ($Ar_3$ transformation point + 30°C), the lowering of the shelf energy is small although delamination appears. However, when the reduction at temperatures below 850°C is more than 85%, improvement of the energy is less even with a finishing temperature not lower than the value ($Ar_3$ transformation point + 30°C). Thus, it is desirable that the total reduction at temperatures not higher than 850°C is limited to 50 – 85% and the finishing rolling is done at a temperature not lower than the value ($Ar_3$ transformation temperature + 30°C).

Concludingly, in order to commercially produce steels for pipes having high shelf energy and a low notch transition temperature, it is preferable that a steel containing not higher than 0.005% of sulfur, 0.005 to 0.025% of REM under the condition of REM/S = 2 – 5, and a suitable amount of one or more of Nb, V and Ti is heated, so as to dissolve in solid solution, either of Nb, V and Ti (when the steel plate for pipes is produced by a heavy gauge rolling process, it is preferable to add both Nb and V) in an amount of at least, 0.01% and then the total reduction at temperatures not higher than 850°C is 50 to 85% and the finishing rolling is done at a temperature not lower than the value ($Ar_3$ transformation point + 30°C).

Reasons for limitations of the steel composition will be explained hereinafter.

Carbon is necessary to be present not higher than 0.25% for toughness and weldability, but in order to avoid lowering of the steel strength, softening of the heat affected zone by welding, and increased difference in strength between the weldment and the steel, it is preferable the lower limit of carbon is set to 0.04%. If permitted, the upper limit of carbon is preferably set to 0.16% so as to avoid deterioration of the steel toughness, hardening of the weldment, and lowering of crack resistance.

Silicon is inevitably contained in the steel due to the deoxidation, and it is added for its large hardenability. However, when silicon is contained in excess the cleanness of the steel deteriorates to lower the high toughness of the steel of the present invention by silicates. On the other hand, if the amount of silicon is too little, the steel notch toughness lowers. Thus, it is preferable that the lower limit be 0.1%.

Manganese is indispensable for improving the steel toughness, but with manganese contents of more than 2.0%, the weldability lowers considerably, and manganese contents lower than 0.5% do not contribute to the strength. Thus the manganese content is defined as being from 0.5 to 2.0%. However, when the manganese content is too small, the steel strength and toughness lower, and the softening of the heat affected zone by welding is considerable. Thus, it is preferable that the lower limit of the manganese content be set to 1.0%, and the upper limit be set to preferably 1.70% with a view towards avoiding lowering of the toughness of the heat-affected zone.

Phosphorus is contained normally as an impurity in an amount not more than 0.025%, and in the present invention phosphorus is not added intentionally.

Regarding the sulfur content, when it is not more than 0.015%, particularly 0.005%, the shelf energy is improved remarkably as mentioned above. Therefore, the sulfur content is limited to not more than 0.015%, and preferably is 0.005%.

Aluminum is necessary for effecting satisfactory deoxidation of the steel, and is effective to the improve toughness by grain refinement and fixation of the nitrogen. However, with sol.Al contents of less than 0.005% no substantial effect can be obtained, and sol.Al contents of more than 0.1% damage the toughness. Thus the sol.Al content is limited to the range from 0.005 to 0.10%. Preferably the lower limit of the sol.Al content is 0.01% and its upper limit is 0.060% in order to avoid significant deterioration in the toughness of the heat-effected zone as well as the weldment.

As for titanium, niobium and vanadium, no improvement of the notch transition temperature can be obtained unless at least one of them is dissolved in solid solution in an amount of not less than 0.01% as mentioned above. Therefore, the lower addition limit of one or more of these elements is set to 0.01%. However, any of these elements deteriorates toughness of the steel material and the heat-affected zone by welding when added in an excessive amount, and for this reason their upper limit is defined. Niobium is effective to improve the notch transition temperature without considerable lowering of the steel toughness, and it may be added up to 0.10%. When the upper limit of niobium is set to 0.06%, it is possible to avoid deterioration of toughness of the heat-affected zone.

Vanadium is similar to niobium, but vanadium may be added up to 0.15%. The upper limit of titanium is 0.10%.

The reasons for limitations of REM and the ratio of REM/S already have been explained hereinbefore.

In addition to the above elements, one or more of not more than 0.50% of nickel, not more than 0.30% of chromium, not more than 0.40% of molybdenum and not more than 0.50% of copper may be added under the conditions that $(Cu + Ni)/5 + Cr + Mo \leq 0.75\%$.

The object of addition of these minor elements in the present invention is to improve the steel strength and toughness and to widen the steel plate thickness range applicable to the present invention, and their addition is naturally limited by other factors.

Nickel is effective to improve the steel strength and toughness without adverse effect on the hardenability and toughness of the heat-affected zone, but nickel contents the more than 0.50% have an adverse effect on the hardenability and toughness of the heat-affected zone. Thus the upper limit of nickel is set to 0.50%.

Too high a chromium content causes increased hardenability of the heat-affected zone, and lowering of the toughness and crack resistance. Therefore, the upper limit of chromium is set to 0.30%.

Molybdenum is similarly effective as chromium, and contributes to improve the various properties of the steel, but its upper limit is defined to 0.40% for its adverse effects on hardenability and toughness of the heat-affected zone.

Copper also has an effect similar to nickel and is further effective to improve the corrosion resistance of the steel. However, copper contents of more than 0.50% cause Cu-cracking during the rolling of the steel so that a good surface condition can not be obtained, thus causing difficulties in the production process. Therefore, the upper limit of copper is defined to 0.50%.

Further, these minor elements can be added only under the condition of $(Cu + Ni)/5 + Cr + Mo \leq 0.75\%$. Otherwise the absorbed energy lowers and hardness of the heat-affected zone is remarkably high and crackings are caused in the heat-affected zone during a small heat-input welding, resulting in an unsuitable steel material for welding. Therefore, these minor elements should be added under the condition that $(Cu + Ni)/5 + Cr + Mo \leq 0.75\%$.

According to the present invention, a steel ingot is prepared by an ordinary steel making method, and the ingot is subjected to soaking and break-down to obtain steel slabs, or steel slabs are prepared by continuous casting directly from molten steel, and these steel slabs are subjected to hot rolling comprising rough-rolling and finishing rolling.

The desirable steel plate thickness in the present invention is about 3 to 20 mm, and as a preferable production process, the steel slab is rolled by a heavy plate mill or a hot rolling mill, and the thus obtained steel plates are formed into pipes.

The present invention will be more clearly understood from the following embodiments.

EXAMPLE 1

In Table 1, the steels A and B are Si-Mn high tensile steels, but the steel B contains La and Ce and the steel A does not contain La and Ce. As understood from the results shown in Table 2, the addtion of La and Ce improves the Charpy absorbed energy remarkably but adversely increases the transition temperature. Steels C to G show the effects of the addition of La and Ce alone or in combination and the effects of the hot rolling conditions in the case of a Nb-containing steel. In steel C, the amounts of La and Ce are too small to obtain a satisfactory absorbed energy and transition temperature. In steel G, the addition of La and Ce is within the scope of the present invention, but the inlet temperature in the finishing rolling is 1050°C which is higher than the scope of the present invention and thus no improvement in the absorbed energy and the transition temperature is obtained. The steels D, E and F are within the scope of the present invention and all show excellent absorbed energy and transition temperatures. The steels H and I compare the effects of the low temperature rolling in the case of Ti-steels containing La and Ce and remarkable improvement of the low-temperature toughness can be obtained by the low-temperature rolling.

EXAMPLE 2

The steel slabs having the compositions shown in Table 3 were rolled by a heavy plate rolling mill under the conditions shown in Table 3, and the results are shown in Table 4.

Table 1

| Steels No. | | C | Si | Mn | P | S | Nb | Ti | Al | La | Ce |
|---|---|---|---|---|---|---|---|---|---|---|---|
| A | Comparative | 0.18 | 0.30 | 1.19 | 0.014 | 0.009 | — | — | 0.037 | — | — |
| B | " | 0.17 | 0.37 | 1.19 | 0.014 | 0.007 | — | — | 0.031 | 0.008 | 0.012 |
| C | " | 0.13 | 0.28 | 1.26 | 0.013 | 0.006 | 0.034 | — | 0.026 | 0.003 | 0.002 |
| D | Present Invention | 0.13 | 0.33 | 1.18 | 0.012 | 0.006 | 0.033 | — | 0.031 | 0.015 | 0.015 |
| E | " | 0.13 | 0.29 | 1.20 | 0.013 | 0.006 | 0.035 | — | 0.030 | 0.020 | — |
| F | " | 0.12 | 0.32 | 1.20 | 0.013 | 0.006 | 0.034 | — | 0.030 | — | 0.018 |
| G | Comparative | 0.12 | 0.31 | 1.18 | 0.013 | 0.006 | 0.029 | — | 0.029 | 0.017 | 0.017 |
| H | " | 0.11 | 0.23 | 1.20 | 0.013 | 0.006 | — | 0.045 | 0.025 | — | — |
| I | Present Invention | 0.12 | 0.24 | 1.20 | 0.013 | 0.007 | — | 0.049 | 0.026 | 0.008 | 0.007 |

| Steels No. | La + Ce | $\frac{La + Ce}{S}$ | Inlet Temp. of Finishing Rolling(°C) | Reduction in Finishing Rolling(%) | Total Reduction of Coil(%)* | Thickness (mm) |
|---|---|---|---|---|---|---|
| A | — | 0 | 970 | 83 | 98 | 4.5 |
| B | 0.020 | 2.9 | 980 | 83 | 98 | 4.5 |
| C | 0.005 | 0.8 | 975 | 76 | 97 | 6.5 |
| D | 0.030 | 5.0 | 960 | 76 | 97 | 6.5 |
| E | 0.020 | 3.3 | 950 | 76 | 97 | 6.5 |
| F | 0.018 | 3.0 | 955 | 76 | 97 | 6.5 |
| G | 0.034 | 5.7 | 1050 | 76 | 97 | 6.5 |
| H | — | 0 | 950 | 66 | 95 | 9.6 |
| I | 0.015 | 2.1 | 930 | 66 | 95 | 9.0 |

*Remark: Total Reduction of Coil means reduction applied to the steel slab prepared by break-down or continuous casting during the hot rolling after the slab heating.

Table 2

| Steels No. | Tensile Test Values (L direction) | | | Charpy Test Values (T direction) | | Size of Charpy Test Specimens |
|---|---|---|---|---|---|---|
| | Yield Point | Tensile Strength | Elongation | vEo | vTrs | |
| A | 39.4kg/mm² | 56.0kg/mm² | 34.0% | 1.8kg-m | −70 °C | 4.5mm |
| B | 40.6 | 57.2 | 33.0 | 4.6 | −45 | 4.5 |
| C | 53.7 | 63.6 | 29.0 | 3.4 | −77 | 5 |
| D | 56.6 | 63.4 | 28.3 | 5.5 | −110 | 5 |
| E | 56.3 | 63.2 | 29.0 | 5.6 | −105 | 5 |
| F | 57.2 | 64.1 | 28.5 | 5.1 | −100 | 5 |
| G | 59.7 | 67.1 | 27.7 | 5.3 | −65 | 5 |
| H | 52.0 | 60.3 | 31.0 | 4.2 | −40 | 6.7 |
| I | 50.1 | 59.6 | 32.3 | 5.8 | −73 | 6.7 |

Table 3

| | Steel No. | Chemical Compositions (% by weight, Balance : Fe) | | | | | | | | | | | | | | (Cu+Ni)/5 +Cr+Mo |
|---|---|---|---|---|---|---|---|---|---|---|---|---|---|---|---|---|
| | | C | Si | Mn | P | S | Nb | V | Ni | Cr | Mo | Cu | sol. Al | REM | REM/S | |
| Comparative | 1 | 0.12 | 0.28 | 1.36 | 0.018 | 0.003 | 0.02 | — | | | | | 0.030 | — | — | |
| | 2 | 0.09 | 0.28 | 1.41 | 0.019 | 0.004 | 0.02 | — | | | | | 0.028 | 0.005 | 1.3 | |
| | 3 | 0.14 | 0.21 | 1.23 | 0.016 | 0.003 | 0.06 | — | | | | | 0.024 | 0.012 | 4.0 | |
| | 4 | 0.12 | 0.29 | 1.26 | 0.019 | 0.003 | — | 0.04 | | | | | 0.027 | 0.009 | 3.0 | |
| | 5 | 0.11 | 0.25 | 1.30 | 0.018 | 0.005 | 0.04 | — | | | | | 0.029 | 0.017 | 3.4 | |
| Present Invention | 6 | 0.12 | 0.27 | 1.41 | 0.013 | 0.003 | — | 0.03 | | | | | 0.024 | 0.011 | 3.7 | |
| | 7 | 0.16 | 0.25 | 1.26 | 0.013 | 0.002 | 0.04 | — | | | | | 0.021 | 0.006 | 3.0 | |
| | 8 | 0.10 | 0.23 | 1.40 | 0.017 | 0.003 | 0.04 | — | | | | | 0.029 | 0.010 | 3.3 | |
| | 9 | 0.12 | 0.24 | 1.30 | 0.015 | 0.005 | 0.02 | 0.04 | | | | | 0.024 | 0.014 | 2.8 | |
| Comparative | 10 | 0.10 | 0.21 | 1.25 | 0.016 | 0.004 | 0.03 | — | — | — | 0.24 | — | 0.023 | — | — | 0.24 |
| | 11 | 0.14 | 0.29 | 1.30 | 0.013 | 0.003 | — | 0.04 | 0.75 | — | 0.28 | — | 0.029 | 0.010 | 3.3 | 0.43 |
| Present Invention | 12 | 0.12 | 0.20 | 1.26 | 0.019 | 0.003 | — | 0.03 | — | 0.21 | — | — | 0.024 | 0.011 | 3.7 | 0.21 |
| | 13 | 0.12 | 0.24 | 1.32 | 0.013 | 0.002 | 0.04 | — | 0.25 | — | — | 0.26 | 0.025 | 0.009 | 4.5 | 0.10 |

| Steel No. | Rolling Conditions: Temp. which dissolve in solid solution 0.1% of Nb or V | Heating Temp. | Amount of sol. Nb or V at Heating | | Reduction at Temp. not higher than 850°C | $Ar_3$+30°C | Finishing Temp. | Thickness |
|---|---|---|---|---|---|---|---|---|
| | °C | °C | sol.Nb | % | % | °C | °C | mm |
| 1 | 1035 | 1250 | | 0.02 | 80 | 733 | 742 | 15 |
| 2 | 1010 | " | " | 0.02 | 80 | 742 | 755 | 15 |
| 3 | 1055 | 1000 | " | 0.006 | 82 | 751 | 765 | 10 |
| 4 | 900 | 1150 | sol.V | 0.04 | 35 | 756 | 790 | 10 |
| 5 | 1030 | 1250 | sol.Nb | 0.04 | 80 | 759 | 721 | 15 |
| 6 | 900 | " | sol.V | 0.03 | 82 | 724 | 745 | 10 |
| 7 | 1070 | " | sol.Nb | 0.04 | 73 | 739 | 752 | 15 |
| 8 | 1020 | 1150 | " | 0.03 | 82 | 737 | 760 | 10 |
| 9 | 900 | 1250 | sol.Nb | 0.02 | 55 | 748 | 772 | 15 |

Table 3-continued

| | | | | | | | | |
|---|---|---|---|---|---|---|---|---|
| | | | sol.V | 0.04 | | | | |
| 10 | 1020 | 1250 | sol.Nb | 0.03 | 55 | 769 | 782 | 15 |
| 11 | 870 | " | sol.V | 0.04 | 82 | 735 | 743 | 10 |
| 12 | 890 | " | sol.V | 0.03 | 82 | 758 | 769 | 10 |
| 13 | 1040 | 1150 | sol.Nb | 0.04 | 80 | 756 | 771 | 15 |

Table 4

| Steel No. | | Tensile Test Values (T direction) | | | Charpy Test Values (T direction) | | Size of Charpy Test Specimens |
|---|---|---|---|---|---|---|---|
| | | Yield Point | Tensile Strength | Elongation | $vE_{20}$ | vTrs | |
| | | kg/mm² | kg/mm² | % | kg-m/cm² | °C | |
| 1 | Comparative | 43.6 | 52.3 | 50 | 8.3 | −80 | Full size |
| 2 | " | 42.3 | 51.0 | 48 | 9.5 | −78 | " |
| 3 | " | 39.0 | 51.2 | 47 | 13.2 | −35 | ¾ Sub size |
| 4 | " | 44.0 | 53.2 | 42 | 15.1 | −32 | " |
| 5 | " | 50.3 | 59.0 | 38 | 7.0 | −86 | Full size |
| 6 | Present Invention | 49.0 | 58.1 | 39 | 20.3 | −85 | ¾ Sub size |
| 7 | " | 46.9 | 58.2 | 46 | 19.6 | −93 | Full size |
| 8 | " | 51.1 | 59.5 | 36 | 20.5 | −96 | ¾Sub size |
| 9 | " | 50.4 | 61.6 | 43 | 19.3 | −92 | Full size |
| 10 | Comparative | 51.4 | 57.2 | 42 | 9.0 | −80 | " |
| 11 | " | 55.0 | 65.2 | 38 | 9.8 | −80 | ¾ Sub size |
| 12 | Present Invention | 53.2 | 62.4 | 40 | 19.4 | −90 | " |
| 13 | " | 56.0 | 62.8 | 39 | 21.3 | −82 | Full size |

As described above, the present invention provides a novel process which can improve the absorbed energy by the specific ratio of REM/S and lower the transition temperature by combination with the low-temperature rolling, and has a great industrial advantage that it can produce economically high-tensile steels suitable for hot strips and non-tempered heavy gauge steel plates, etc., having low-temperature toughness for welded pipes and components of machinary used in the cold districts which require such low-temperature toughness.

What is claimed is:

1. A method for producing a high toughness and high tensile steel which comprises heating a steel containing 0.04 to 0.16% of carbon, 0.10 to 0.50% of silicon, 1.0 to 1.70% of manganese, not more than 0.025% of phosphorus, not more than 0.005% of sulfur, 0.010 to 0.060% of aluminum, one or more 0.01 to 0.06% of niobium, and 0.01 to 0.15% of vanadium, 0.005 to 0.025% of REM under the condition of REM/S = 2 to 5, with the balance being iron and unavoidable impurities, to a temperature such that at least 0.01% of the steel is niobium or vanadium in solid solution, and finishing rolling the thus heated steel with a total reduction of 50 to 85% in a temperature range not higher than 850°C but not lower than the sum of the $Ar_3$ transformation point plus 30°C.

2. A method for producing a high toughness and high tensile steel which comprises heating a steel containing 0.04 to 0.16% of carbon, 0.10 to 0.5% of silicon, 1.0 to 1.70% of manganese, not more than 0.025% of phosphorus, not more than 0.005% of sulfur, 0.010 to 0.06% of aluminum, one or more of 0.01 to 0.06% of niobium and 0.01 to 0.15% of vanadium, 0.005 to 0.025% of REM under the condition of REM/S = 2 to 5, and further one or more of not more than 0.50% of nickel, not more than 0.30% of chromium, not more than 0.40% of molybdenum, and not more than 0.50% of copper under the condition of (Cu + Ni)/5 + Cr + Mo ≤ 0.75%, with the balance being iron and unavoidable impurities, to a temperature such that at least 0.01% of the steel is niobium or vanadium in solid solution, and finishing rolling the thus heated steel with a total reduction of 50 to 85% in a temperature range not higher than 850°C but not lower than the sum of the $Ar_3$ transformation point plus 30°C.

3. A method for producing high toughness and high tensile steel sheets and strips comprising heating a steel containing not more than 0.25% of carbon, not more than 0.5% of silicon, 0.5 to 2.0% of manganese, not more than 0.025% of phosphorus, not more than 0.015% of sulfur, 0.005 to 0.1% of aluminum, not less than 0.01% in total of one or more selected from the group consisting of niobium, vanadium and titanium, and REM in an amount not less than 1.3 times the sulfur with the balance being iron and unavoidable impurities to a temperature such that at least 0.01% of the steel is of niobium, vanadium, or titanium is in solid solution, and hot rolling so as to have a finishing rolling with a reduction of not less than 60% in a temperature range not higher than 980°C but not lower than the sum of the $Ar_3$ transformation point plus 30°C.

* * * * *